United States Patent [19]

Hansen

[11] 4,134,629

[45] Jan. 16, 1979

[54] PIVOTABLE SHELVING HAVING AN ASSOCIATED PIVOTABLE DOOR

[75] Inventor: George E. Hansen, Los Altos, Calif.

[73] Assignee: Roger G. Holmes, San Lorenzo, Calif.

[21] Appl. No.: 708,905

[22] Filed: Jul. 26, 1976

[51] Int. Cl.[2] ..... A47B 46/00

[52] U.S. Cl. ..... 312/246; 312/273

[58] Field of Search ..... 312/245, 246, 248, 273, 312/294; 108/33, 48

[56] References Cited

U.S. PATENT DOCUMENTS

| | | | |
|---|---|---|---|
| 605,222 | 6/1898 | Gartner | 312/273 |
| 1,652,984 | 12/1927 | Hixson | 312/273 |
| 1,907,322 | 5/1933 | Keicher | 108/33 X |

FOREIGN PATENT DOCUMENTS

| | | | |
|---|---|---|---|
| 637270 | 3/1962 | Italy | 312/273 |

*Primary Examiner*—Mervin Stein
*Assistant Examiner*—David H. Corbin
*Attorney, Agent, or Firm*—Harry E. Aine; Harvey G. Lowhurst

[57] ABSTRACT

A kitchen cabinet is disclosed which includes a pivot support for supporting a plurality of kitchen cabinet shelves so that the shelves may pivot about a horizontal axis outwardly and downwardly toward the user to an access position for gaining access to the shelves. The shelves are returned to the storage position by pivoting the shelves back up into the storage position. A pivotable and foldable door having upper and lower panels is pivotably supported from the ceiling. The door is actuated by means of mechanical linkages interconnecting the shelving and the door. As the shelving is pivoted from the storage position into the access position, the door, which covers the front side of the shelving, is pivoted upwardly and away from the shelving to permit access thereto. The lower section of the door includes a linkage for folding the lower panel up toward the underside of the upper panel. A shelf stabilizing linkage is provided which maintains the shelving in the horizontal position while it pivots between the storage and access positions. The kitchen cabinet is readily hung from a vertical wall by means of a horizontal mounting bar affixed to the studs thereof. Hangers serve to hang the pivotable support for the shelving from the mounting bar. The pivotable support for the door structure is affixed to the ceiling.

16 Claims, 5 Drawing Figures

PIVOTABLE SHELVING HAVING AN ASSOCIATED PIVOTABLE DOOR

BACKGROUND OF THE INVENTION

The invention relates in general to shelving and more particularly to cabinet shelving which is pivotable downwardly and outwardly from a storage position to an access position and including a cabinet door structure which is mechanically interconnected with the shelving for opening and closing therewith.

DESCRIPTION OF THE PRIOR ART

Heretofore, it has been proposed to provide shelving which is pivotably mounted in a cabinet and which can be pivoted outwardly and downwardly between a storage position and an access position. However, there was no provision for a cabinet door structure operatively associated with movement of the shelving. Also, the shelving was removable and nothing was provided for maintaining the shelving in the horizontal position as it was pivoted outwardly and downwardly from its storage position. Such portable shelving is disclosed and claimed in U.S. Pat. No. 589,318 issued Aug. 31, 1897.

It is also known, in the case of a chest, to have a retractable shelf structure mechanically associated with the lid of the chest such that as the lid of the chest is pivoted upwardly on a hinge at its rear edge, a shelf structure is lifted upwardly and maintained in a horizontal state for access thereto. Such a chest is disclosed and claimed in U.S. Pat. No. 2,258,838 issued Oct. 14, 1941.

Furthermore, it is known from the prior art with regard to cabinets, to provide doors for the cabinet in such a manner that one of the doors of the cabinet is mechanically associated with the other door. The mechanical association was such that in opening one door and sliding it back into the cabinet, a mechanical linkage interconnecting the second door is actuated to fold the second door upwardly for access to the cabinet. Such a cabinet is disclosed and claimed in U.S. Pat. No. 2,886,394 issued May 12, 1959.

The conventional kitchen cabinet for use over a sink or counter includes a door which is pivotable along one vertical side edge thereof for pivoting inwardly toward the shelving for closing of the door and which pivots outwardly toward the user for opening and gaining access to the shelves. The shelves are fixed in position and the top shelves are generally inaccessible to the user without the aid of a ladder, foot-stool or the like.

SUMMARY OF THE PRESENT INVENTION

The principal object of the present invention is the provision of an improved cabinet particularly useful as a kitchen cabinet disposed over a sink or counter and which is pivotably mounted for pivoting downward for access and which includes a retractable door mechanically associated with the shelves.

In one feature of the present invention, a shelf structure is pivotably mounted so as to pivot downwardly toward the user to an access position and pivot upwardly and away from the user for storage and which includes a door structure mechanically operatively associated with the shelf structure in such a manner that as the shelf structure is pivoted into the access position, the door structure pivots away from the shelving so as to facilitate access to the shelving by the operator, such door structure pivoting in concert with the shelf so as to close over the shelving when the shelving is pivoted into the storage position.

In another feature of the present invention, the door structure is mechanically coupled to the shelf structure in such a manner so that as the shelf structure is pivoted outwardly and downwardly toward the user, the door structure pivots upwardly and out of the way of the user for gaining access to the shelves.

In another feature of the present invention, a shelf stabilizing linkage is provided for holding the shelving in the horizontal position as the shelving is pivoted about a horizontal axis from a storage position to an access position.

In another feature of the present invention, the shelving is mounted to a vertical wall structure via the intermediary of a horizontal mounting bar fixedly secured to the wall structure and a hanger structure which supports the shelving, such hanger structure being affixed to the mounting bar in use.

In another feature of the present invention, the retractable door structure, which is mechanically associated with the shelving, is pivotably mounted to the ceiling for pivotable movement relative thereto.

Other features and advantages of the present invention will become apparent upon a perusal of the following specification taken in connection with the accompanying drawings wherein:

DESCRIPTION OF THE PREFERRED EMBODIMENTS

Figure 1:
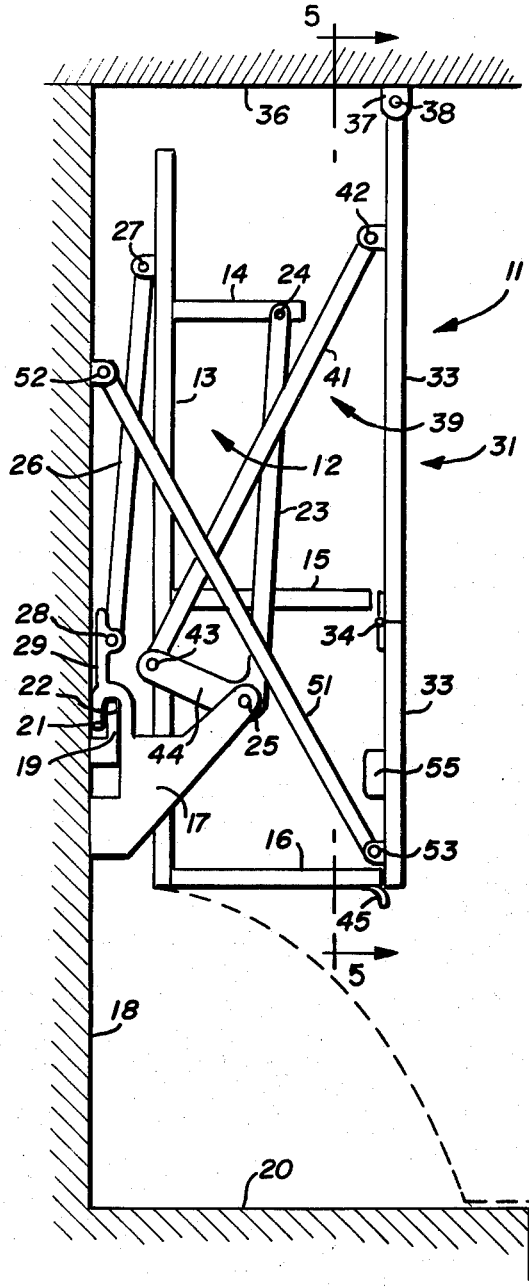
FIG. 1 is a side elevational view of a kitchen cabinet structure incorporating features of the present invention.
Figure 2:
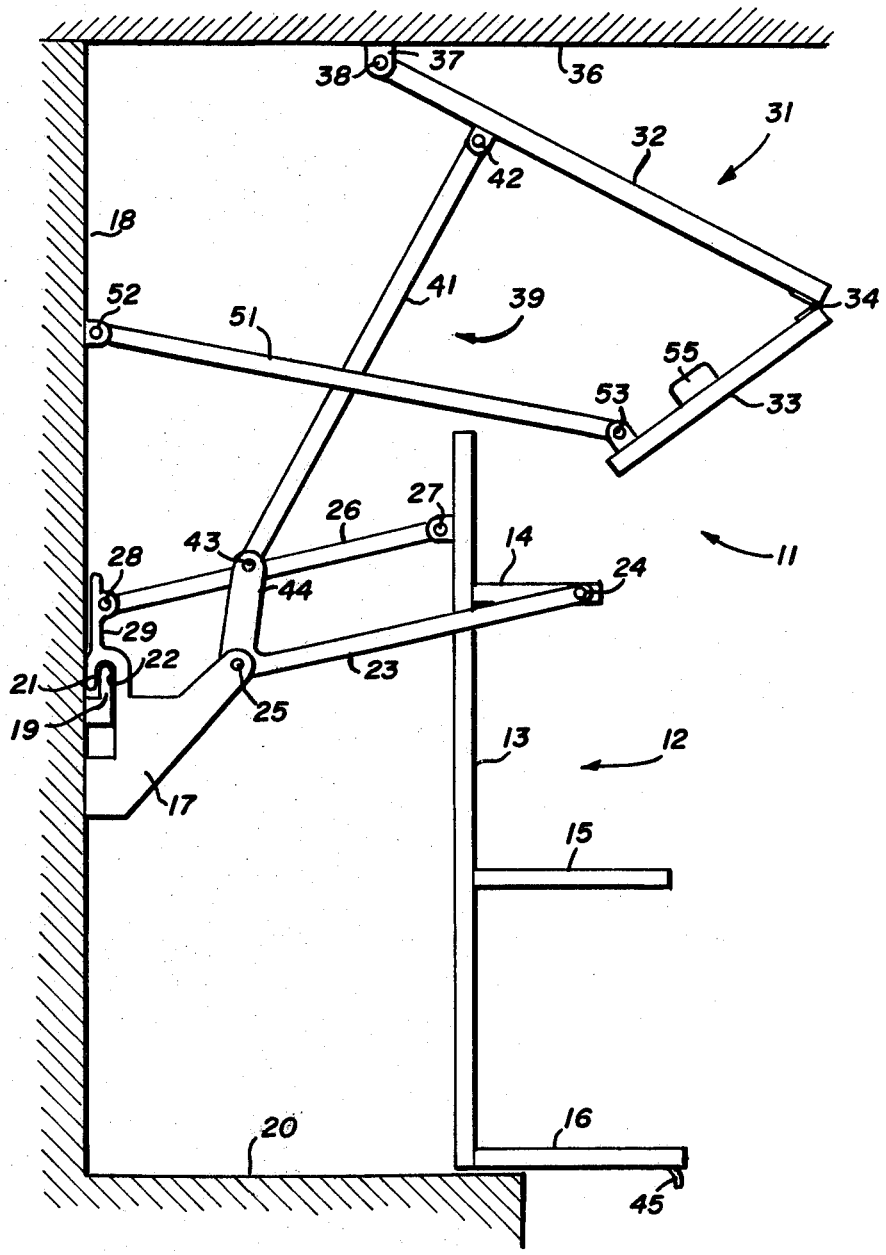
FIG. 2 is a side elevational view of the structure of FIG. 1 showing the shelving and door structure in the access position.

Referring now to FIGS. 1 and 2 there is shown a kitchen cabinet 11 incorporating features of the present invention. The cabinet 11 includes a shelf structure 12 having a generally vertically directed backplate portion 13 and top, middle and bottom shelves 14, 15 and 16 extending outwardly therefrom with the shelf surface thereof being positioned in a generally horizontal plane to receive items to be stored upon the shelves 14–16. If desired, the side ends of the shelves 14–16 may be closed off via vertical side end closing walls (not shown).

The shelf structure 12 is pivotably supported from a pair of hangers 17 disposed at opposite side ends of the shelf structure 12. More particularly, the hanger structure 17 is mounted to a vertical wall 18 via the intermediary of a horizontal mounting bar structure 19 fixedly secured to the studs of the wall 18 via screws or the like. Mounting bar 19 includes a lip portion 21 spaced from the wall to permit a hook portion 22 of the hanger 17 to hook over the upper lip of the mounting bar 21. A lower portion of the hanger bears against the wall for support therefrom.

The shelf structure 12 is pivotably supported from the hangers 17 by means of mechanical linkages 23 pivotably mounted to the opposite ends of shelf structure 12 at pins 24 on the top shelf 14 and to the hangers 17 at pivots 25. A stabilizing linkage 26 interconnects a midpoint along the length of the shelf structure 12 at pivot 27 and a midpoint between the hangers 17 at pivot 28. Pivot 28 is fixedly secured between the hangers 17 via the intermediary of a cross member 29 horizontally interconnecting the two hangers 17.

Pivots 24, 25, 27 and 28 all provide pivoting about a horizontal axis and each of the respective pivot axes are located at the four corners of a parallelogram interconnecting said axes so that as the shelf structure 12 pivots outwardly and downwardly to the access position as shown in FIG. 2, parallelism is maintained between a straight line interconnecting pivot axes 24 and 27 and between a straight line interconnecting pivot axes 25 and 28. In this manner the horizontal attitude of the shelving is maintained constant during the pivoting action of the shelving about the pivot axis 25.

A door structure 31 is provided for closing off access to the storage shelves 12 when the storage shelves are in the stored position. The door structure 31 includes a top panel portion 32 hinged to a lower panel portion 33 via a hinge structure 34 having a horizontal pivotable axis. The upper end of the upper panel 32 is pivotably supported from a ceiling 36 via the intermediary of a pair of brackets 37 fixedly secured to the ceiling at opposite side ends of the door 31 via suitable screws or the like and including pivots 38 providing pivoting of the door structure 31 about a horizontal pivot axis in axial alignment with pivots 38.

A door actuating structure 39 mechanically interconnects the door structure 31 with the shelf structure 12 so that pivotable movement of the shelf structure 12 between the storage and access positions causes the door structure 31 to pivot between the closed position, as shown in FIG. 1, and the access position, as shown in FIG. 2. More particularly, the door actuator structure 39 includes a pair of mechanical links 41 disposed at opposite ends of the shelves. The mechanical links 41 are pivotably coupled at one end to the top panel 32 of the door at opposite side edge positions 42 which are below the pivots 38. The other end of each of the mechanical links 41 is pivotably connected at 43 to one end of a lever arm 44 extending outwardly from and being fixedly secured to each of the shelf links 23. In this manner, as the shelf structure 12 is pivoted outwardly and downwardly by the operator pulling on a hangle 45 at the center lip of lower shelf 16, the lever arm 44 tends to rotate upwardly about the pivot axis 24 causing the upper end of each link 41 to push up on the upper panel 32 of the door structure to pivot same upwardly around the pivots 38.

As the upper panel 32 is pivoted upwardly toward the ceiling, a second pair of mechanical links 51, one provided at each opposite end of the shelving 12 and pivotably supported at one end from the wall 18 at 52 and the lower ends of which are pivotably connected to the lower door panel 33 at 53, causes the lower door panel 33 to be folded upwardly toward the inside surface of the upper door panel portion 32 of the door structure 31, as shown in FIG. 2. In this manner, as the shelf structure 12 is pivotably moved from the storage position to the access position, the door structure 31 is caused to pivot upwardly and to fold back on itself to permit full access to the shelf structure 12 including the top shelf 14.

A counterweight 55, such as a magnet of a few pounds weight, is affixed to the door structure 31 preferably to the inside surface of the lower panel 33, as by magnetic coupling to a metal plate (not shown) affixed to the inside of the lower door panel 33. The position of the counterweight 55 is adjustable toward and away from the pivot 38 of the door 31 in such a manner as to adjust the counter balancing force between the weight of items stored on the shelf structure 12 and the weight of the door structure 31. This permits the user to counterbalance the door 31 and shelf structure 12.

Figure 3:
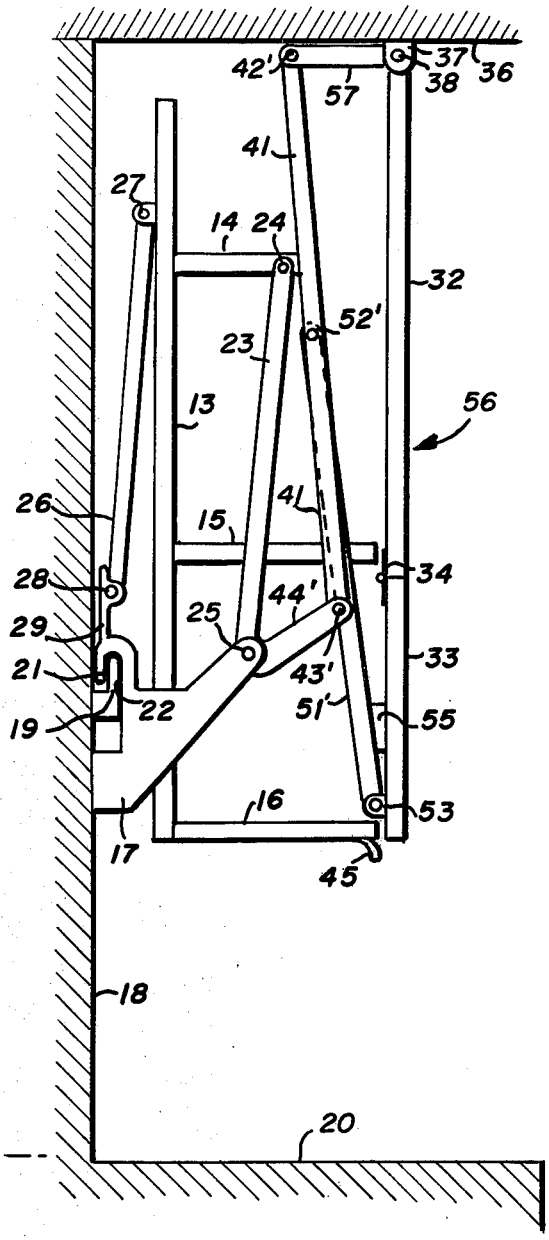
FIG. 3 is a view similar to that of FIG. 1 depicting an alternative embodiment of the present invention.
Figure 4:
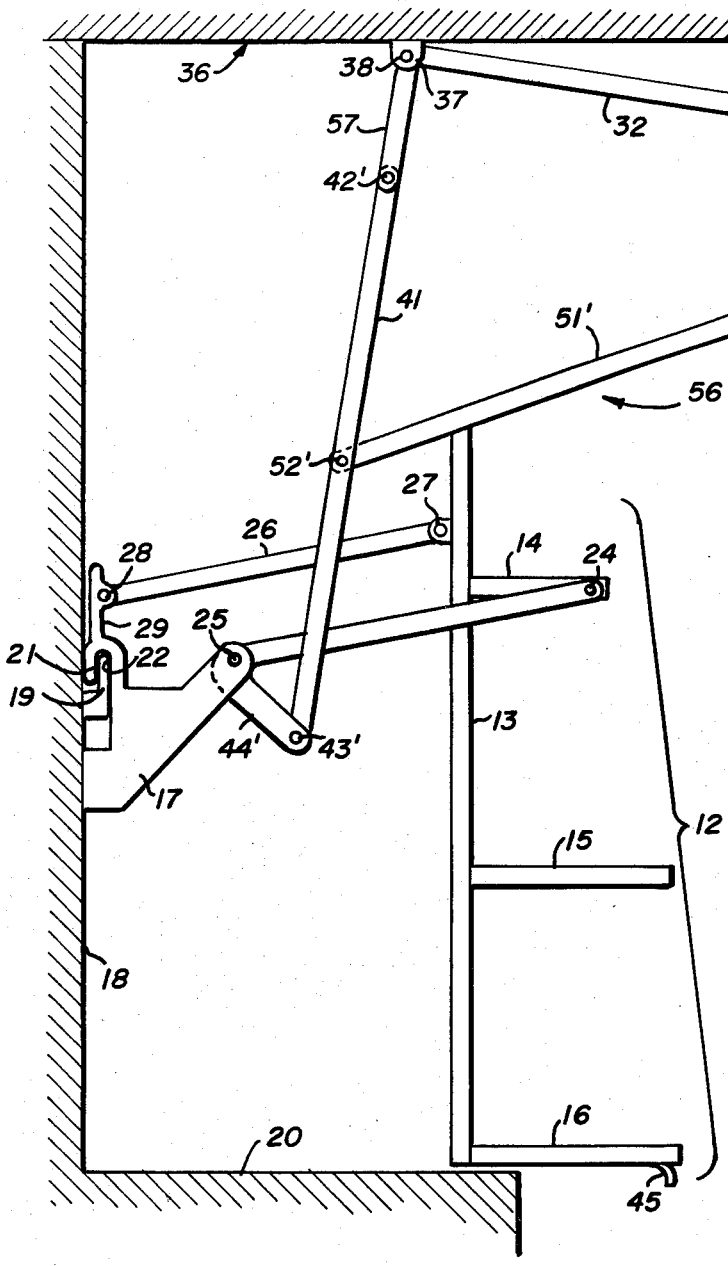
FIG. 4 is a view similar to that of FIG. 2 for the alternative embodiment of FIG. 3.

Referring now to FIGS. 3 and 4, there is shown an alternative kitchen cabinet structure 56 of the present invention. The cabinet structure 56 of FIGS. 3 and 4 is essentially the same as that of FIGS. 1 and 2 with the exception that a portion of the upper door panel 32 between pivot 38 and pivot 42 is replaced by a pair of arms 57 each joined at one end to opposite side ends of the upper door panel 32. The lever arm 44 is reversed at 44' to extend outwardly from the pivot 25 toward the user and a pair of links 41 interconnect the inner end of arms 57 and the outer end of lever arms 44'. Now, as the user pulls the shelf structure 12 downwardly and outwardly, the lever arms 44' pull downwardly on arms 57 to swing the upper door panel 32 upwardly and outwardly about its pivot 38. The outwardly and downwardly pivoting motion of the shelf structure 12 continues until such time as lever arm 57 is vertical or nearly vertical, thereby serving as a stop for the shelf structure 12 to prevent any further outwardly and downwardly pivoting thereof about pivot axis 25. This is shown in FIG. 4.

Also, the lower door panel 33 is caused to fold inwardly by means of mechanical links 51' interconnecting the opposite side edges of the lower end of the lower door panel 33 at 53 and pivots 52' connected intermediate the length of each of the links 41'.

Figure 5:
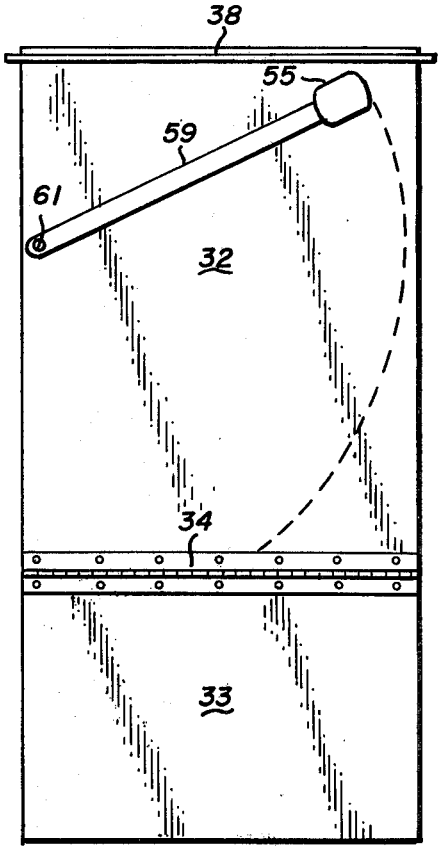
FIG. 5 is a view of the structure of FIG. 1 taken along line 5—5 in the direction of the arrows and showing a counterweight alternative embodiment of the present invention.

Referring now to FIG. 5, there is shown an alternative embodiment for the counterweight structure. More particularly, the counterweight 55 is carried from the end of a shaft 59 pivotably connected at one end 61 to the inside surface of the top door panel 32. A friction lock such as a wing nut (not shown) provides a friction connection of the arm 59 to the pivot 61 so that the angular position of the counterweight relative to the pivot 61 can be selected and frictionally locked in position. The shelf structure is then counterweighted by selecting the proper angular position of the arm 59 relative to the pivot point 61. The counterweight position which corresponds to the uppermost extent of angular travel of the arm 59 provides the least amount of counterweighting.

The advantages of the retractable shelf structure of the present invention, as contrasted with the prior art, include the ability of the user to merely pull the shelf structure downwardly and outwardly toward the lip of the counter-top 20 so as not to interfere with items stored upon the countertop, whereby the items stored on the shelf structure are within ready access to the user. In this process, the cabinet door structure 31 pivots up and out of the way to permit full access to all the shelves 12 including the top shelf 14. The cabinet has the advantage of being easy to install in that it is hung from the horizontal mounting bar 19 and the door structure is hung from the ceiling via brackets 37. A variable weight load of items stored on the shelf structure 12 is readily compensated by adjustment of the counterweight structures associated with the door 31.

What is claimed is:

1. In a kitchen cabinet for supporting items and having a door structure for closing off access to the shelf structure:

shelf means for providing a generally horizontal platform for supporting items to be stored thereon;

shelf pivot means for connecting said shelf means to a support structure and for pivotably supporting said shelf means relative to the support structure and for pivoting of said shelf means outwardly and downwardly about a generally horizontal pivot axis of said shelf pivot means toward the user to a lower access position for permitting ready access thereto for the user;

door means for movement relative to said shelf means for closing off access to said shelf means when said shelf means is in the elevated storage position and for opening thereof to permit access to said shelf means when said shelf means is pivoted into said lower access position; and door actuating means operatively associated with said shelf means and said door means for actuation of said door means in concert with pivoting movement of said shelf means between said storage and access positions for closing said door means over said shelf means when said shelf means is pivoted into said storage position and for opening said door means for access to said shelf means when said shelf means is pivoted into said access position.

2. The apparatus of claim 1 wherein said door actuating means includes a door pivot means for pivoting said door means about a horizontal pivot axis and for pivoting said door means outwardly and upwardly about said door pivot axis into an access position for permitting access to said shelf means when said shelf means is pivoted into said access position and for pivoting said door means inwardly and downwardly for closing over said shelf means when said shelf means is pivoted upwardly into said storage position.

3. The apparatus of claim 2 wherein said door means includes upper and lower door panels, and hinge means for hingedly coupling said upper and lower panels of said door means together and for pivotably hinging said lower door panel from said upper door panel along a horizontal pivot axis, and wherein said door actuating means includes linkage means for folding said lower panel of said door means upwardly and inwardly toward the underside of said upper door panel when said upper door panel is pivoted upwardly and outwardly into said door access position from said door storage position.

4. The apparatus of claim 1 wherein said shelf pivot means includes shelf stabilizing means for providing a second pivotable support of said shelf means relative to the support structure and for holding said horizontal platform of said shelf means generally horizontal and level during pivoting of said shelf means between said shelf storage and access positions.

5. The apparatus of claim 1 wherein said door actuating means includes a mechanical linkage structure interconnecting said door means and said shelf means for causing said shelf means and said door means to pivotably move in concert between said respective storage and access positions thereof.

6. The apparatus of claim 5 including counterweight means operatively associated with said door means and movable toward and away from said door pivot means for counterbalancing various different weight loads to be carried from said shelf means.

7. The apparatus of claim 1 including hanger means for carrying said shelf pivot means and for attachment to the support structure for supporting said shelf means from the support structure.

8. The apparatus of claim 7 wherein the support structure comprises a vertical wall structure and including, mounting bar means for rigid attachment to said vertical wall structure and wherein said hanger means is adapted to be secured to said mounting bar means for carrying said hanger means for said mounting bar means.

9. The apparatus of claim 2 including door mounting means for mounting said door pivot means to a ceiling wall structure for support therefrom.

10. The apparatus of claim 5 wherein said mechanical linkage interconnecting said shelf means and said door means includes a first lever arm coupled to said shelf means for movement therewith and pivotable about said shelf pivot axis, a second lever arm coupled to said door means for pivotable movement therewith and pivotable about said door pivot axis, a mechanical linkage portion pivotably connected at one end to said first lever arm and pivotably connected at the other end to said second lever arm.

11. The apparatus of claim 10 wherein said first lever arm projects forwardly from said shelf pivot axis and said second lever arm projects rearwardly from said door pivot axis.

12. The apparatus of claim 10 wherein said first lever arm projects rearwardly from said shelf pivot axis and said second lever arm projects forwardly from said door pivot axis when said door means is in the door access position.

13. In a kitchen cabinet:

shelf means for providing a plurality of generally horizontal platforms arranged in vertically spaced relation for supporting items to be stored thereon;

shelf pivot means for connecting said shelf means to a support structure and for pivotably supporting said shelf means relative to the support structure for pivoting of said shelf means about a generally horizontal pivot axis between a storage position and a shelf access position for ready access thereto; and shelf stabilizing means for providing a second pivotable support of said shelf means relative to the support structure and for holding said horizontal platforms of said shelf means generally horizontal, in generally vertical alignment one above the other, and level during pivoting of said shelf means between said shelf storage and access positions.

14. The apparatus of claim 13 including hanger means for carrying said shelf pivot means and for attachment to the support structure for supporting said shelf means from the support structure.

15. The apparatus of claim 14 wherein the support structure comprises a vertical wall structure and including, mounting bar means for rigid attachment to said vertical wall structure and wherein said hanger means is adapted to be secured to said mounting bar means for carrying said hanger means for said mounting bar means.

16. The apparatus of claim 13 wherein said shelf stabilizing means includes a pair of pivotable axes, one at the point of coupling of said shelf stabilizing means to said shelf means and one at the point of coupling of said shelf stabilizing means to a fixed support structure and wherein said shelf pivot means includes a pair of pivotable axes, one of said axes being at the connection of said pivot means to said shelf structure and the other being at the point of coupling of said shelf pivot means for the support structure and wherein said four pivotable axes fall at the corners of a parallelogram, the plane of the parallelogram being perpendicular to the parallel pivoting axes.

* * * * *